313-422 SR
12/5/78 OR 4,128,784

United States Patent [19] [11] 4,128,784
Anderson [45] Dec. 5, 1978

[54] BEAM GUIDE FOR DISPLAY DEVICE WITH BEAM INJECTION MEANS

[75] Inventor: Charles H. Anderson, Rocky Hill, N.J.

[73] Assignee: RCA Corporation, New York, N.Y.

[21] Appl. No.: 835,772

[22] Filed: Sep. 22, 1977

[51] Int. Cl.[2] ..... H01J 29/08
[52] U.S. Cl. ..... 313/422; 313/105 R; 313/400
[58] Field of Search ..... 313/422, 400, 105 R

[56] References Cited

U.S. PATENT DOCUMENTS 4,031,427 6/1977 Stanley ..... 313/422

*Primary Examiner*—Robert Segal
*Assistant Examiner*—Darwin R. Hostetter
*Attorney, Agent, or Firm*—E. M. Whitacre; G. H. Bruestle; D. S. Cohen

[57] ABSTRACT

An evacuated envelope has spaced, substantially parallel flat front and back walls. Along the front wall is a phosphor screen and along the back wall are electron beam guides for guiding beams of electrons along paths substantially parallel to the front wall. The beam guide includes a pair of spaced, parallel plates between which the beams pass and a plurality of aligned openings in the plates with the openings being arranged in rows extending along the paths of the beams. A gun structure which includes at least one cathode is provided at one end of the beam guide plates. The gun structure is adapted to generate the electrons and direct the electrons as beams between the beam guide plates. The beam guide plates have tabs extending from the one end toward the cathode with the tabs being positioned at the ends of the rows of the openings in the plates. The tabs are adapted to generate electrostatic fields which guide the beams from the cathode between the plates along the rows of the openings.

10 Claims, 4 Drawing Figures

BEAM GUIDE FOR DISPLAY DEVICE WITH BEAM INJECTION MEANS

BACKGROUND OF THE INVENTION

The present invention relates to a flat panel display device having electron beam guides and particularly to such a display device in which the beam guides include means for achieving precision injection of the electrons into the guides.

U.S. Pat. No. 4,031,427 to T. O. Stanley, issued June 21, 1977, entitled "Flat Cathode Ray Tube" describes a flat, cathodoluminescent display device which includes in an evacuated envelope beam guides extending along the back wall of the envelope from a gun structure which generates electrons and directs the electrons as beams in the beam guides. The beam guides confine the electrons in the beams as the beams travel along paths parallel to the front wall of the envelope and selectively deflect the beams toward a phosphor screen on the front wall at selected points along the paths of the beams.

Copending application for U.S. Patent, Serial No. 671,358 of W. W. Siekanowicz et al, filed March 29, 1976, now U.S. Pat. No. 4,088,920, issued May 9, 1978, entitled "Flat Display Device with Beam Guide" describes a beam guide for use in the display device of the type described in U.S. Pat. No. 4,031,427. The beam guide includes a pair of spaced, parallel plates extending along and spaced from the back wall of the envelope. The plates have a plurality of aligned openings therethrough with the openings being arranged in rows extending longitudinally along the paths of the beams. Each longitudinal row of the openings constitutes a separate beam guide.

Copending application for U.S. Pat., Ser. No. 784,365 of R. A. Gange, filed Apr. 4, 1977, entitled "Cathode Structure and Method of Operating the Same" discloses a gun structure for use in the display device of the type described in U.S. Pat. No. 4,031,427. The gun structure includes a line cathode having modulation or control electrodes spaced along the line cathode. Potentials applied to the modulation of control electrodes cause the electrons generated by the cathode to be emitted therefrom in the form of beams. The gun structure may include isolation electrodes between the modulation electrodes to assist in confining the electrons in the beams emitted from the gun structure and guiding the beams into the guide structure.

In the use of the gun structure of the Gange application Ser. No. 784,365 and the beam guide of the Siekanowicz et al application Ser. No. 671,358, now U.S. Pat. No. 4,088,920, issued May 9, 1978, in the display device described in U.S. Pat. No. 4,031,427, a problem has arisen with regard to achieving accurate injection of the electron beams from the gun structure into the beam guides along the longitudinal rows of openings in the guide plates. To achieve accurate injection of the electron beams it is not only necessary to provide high precision of the sizes and relative positions of the modulation and isolation electrodes of the gun structure, but also high precision of the position of the gun structure electrodes with respect to the plate openings of the beam guides. Such need for high precision complicates the making and assemblying of the parts of the display device. Therefore, it would be desirable to have a simpler construction of the gun structure and/or the beam guides which would achieve the accurate injection of the electron beams into the beam guides.

SUMMARY OF THE INVENTION

A display device includes an evacuated envelope having spaced, substantially parallel front and back walls. An electron beam guide extends along the back wall for confining electrons in a beam as the beam flows along a path substantially parallel to the front wall and for selectively deflecting the beam toward a phosphor screen along the front wall at selected points along the beam path. At one end of the beam guide is gun means for generating electrons and directing electrons as a beam toward the beam guide. The beam guide also includes means at its gun end for creating an electrostatic field which guides the electron beam from the gun means into the beam guide along the beam path.

DETAILED DESCRIPTION OF THE PREFERRED EMBODIMENT

Figure 1:
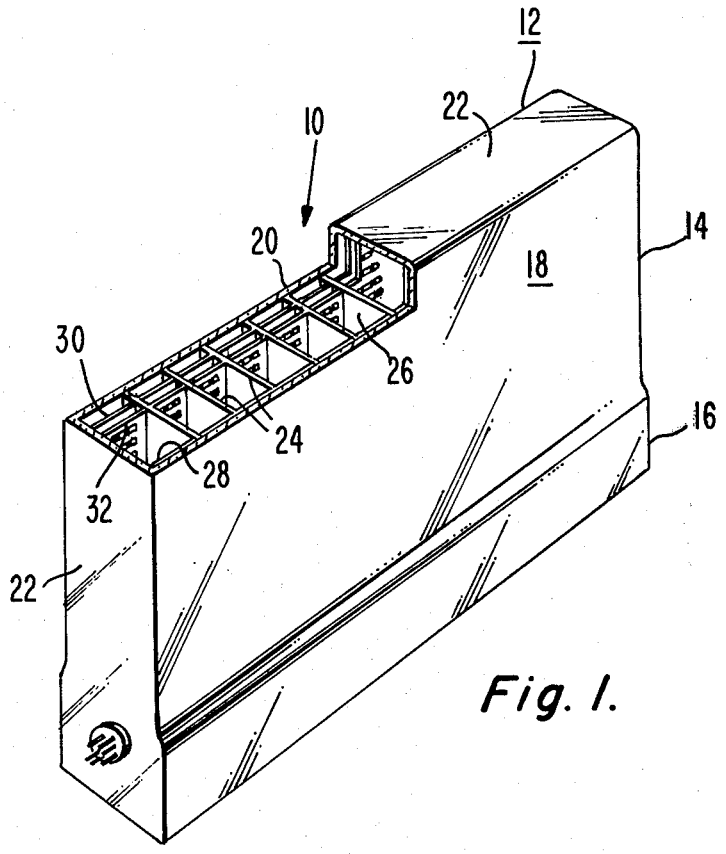
FIG. 1 is a perspective view, partially broken away, of one form of the novel display device.

Referring to FIG. 1, one form of a flat display of the present invention is generally designated as 10. The display device 10 comprises an evacuated envelope 12, typically of glass, having a display section 14 and an electron gun section 16. The display envelope 12 includes a rectangular front wall 18 and a rectangular back wall 20 in spaced parallel relation with the front wall 18. The front wall 18 and the back wall 20 are connected by side walls 22.

A plurality of spaced, parallel support walls 24 are secured between the front wall 18 and the back wall 20 and extend from the gun section 16 to the opposite side wall 22. The support walls 24 provide the desired internal support against external atmospheric pressure and divide the display section 14 into a plurality of channels 26. On the inner surface of the front wall 18 is a screen 28 composed of cathodoluminescent elements which may be of any well known type presently used in cathode ray tubes. In a color display, for example, the phosphor screen in each of the channels 26 alternate between red, green and blue light emitting phosphor strips or elements.

Figure 2:
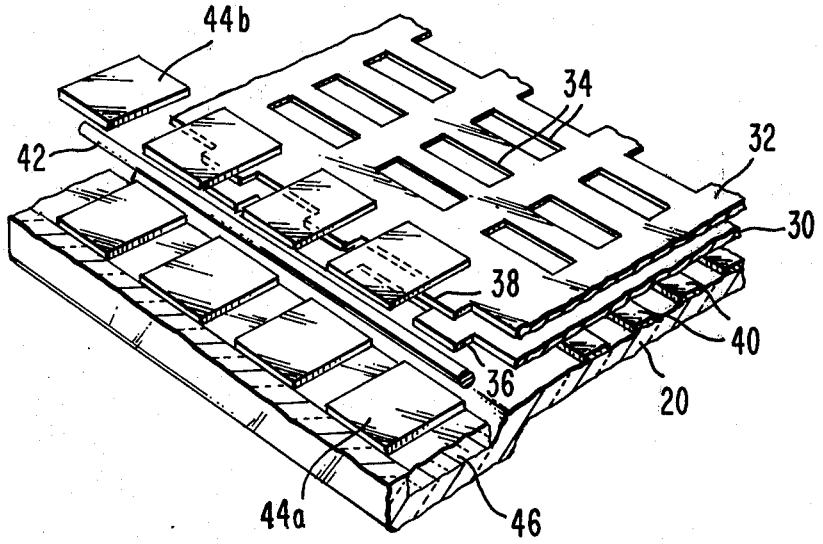
FIG. 2 is a perspective view of a portion of the beam guide and gun structure of the display device of FIG. 1.

In each of the channels 26 is a beam guide assembly of the type described in the previously referred to copending application, Ser. No. 671,358, now U.S. Pat. No. 4,088,920, issued May 9, 1978. As shown in FIG. 2, each of the beam guide assemblies includes a pair of spaced, parallel beam guide plates 30 and 32 extending transversely across the channel 26 and longitudinally along the channel from the gun section 16 to the opposite side wall 22. The beam guide plate 30 is adjacent and parallel to the back wall 20 of the envelope 12 and the beam guide plate 32 is between the beam guide plate 30 and the front wall 18. The beam guide plate 32 has a plurality of openings 34 therethrough with the openings 34 being arranged in rows transversely across and longitudinally along the channel 26. The beam guide plate 30 has similar openings (not shown) therethrough with each of the openings in the beam guide plate 30 being in alignment with a separate opening 34 in the beam guide plate 32. Each pair of longitudinal rows of the openings in the beam guide plates form a separate beam guide along the channel 26.

The beam guide plates 30 and 32 have a plurality of tabs 36 and 38, respectively, projecting from their ends which are adjacent the gun section 16. Each of the tabs 36 and 38 is in alignment with a separate longitudinal row of the openings in the respective guide plate 30 and 32, and is of a dimension transversely across the channel 26 less than the corresponding dimension of the openings in the guide plates. Each of the tabs 38 is in opposed overlapping relation with a separate tab 36.

A plurality of spaced, parallel conductors 40 are on the back wall 20. The conductors 40 extend transversely across the channels 26 with each conductor 40 extending along a separate transverse row of the openings in the beam guide plates 30 and 32. The conductors 40 are strips of an electrically conductive metal coated on or bonded to the back wall 20.

In the gun section 16 of the envelope 12 is a gun structure of the type shown and described in the previously referred to copending application, Ser. No. 784,365. As shown in FIG. 2, this gun structure includes a line cathode 42 of a filament of a metal which will withstand high temperatures, such as tungsten, coated with an emissive material, such as an emissive oxide. One suitable emissive oxide is formed from a mixture of about 13% calcium carbonate, 31% strontium carbonate and 56% barium carbonate which is heated to convert the carbonates to the oxides. The cathode 42 extends transversely across at least one of the channels 26 and is positioned in a plane which is parallel and between the planes of the beam guide plates 30 and 32. The cathode 42 is held under tension, such as by springs (not shown) at the ends of the cathode. There may be a single cathode across each of the cavities 26, or across several of the channels 26 or a single cathode across all of the channels.

A plurality of pairs of modulation or control electrodes **44*a* and 44*b* are spaced along the cathode 42 with the cathode extending between the electrodes of each pair. The modulation electrodes 44*a* and 44*b* of each pair are in overlapping relation and are parallel to each other and to the beam guide plates 30 and 32. Each pair of the modulation electrodes 44*a* and 44*b* is in direct alignment with a separate longitudinal row of the openings in the beam guide plates 30 and 32 and are of a dimension transversely of the channels 26 as least as large and preferably substantially equal to the corresponding dimension of the openings in the beam guide plates. The modulation electrodes 44*a* and 44*b* of each pair are spaced a substantially equal distance from the cathode 42 and are spaced from each other a distance slightly greater than the spacing between the beam guide plates 30 and 32. As shown in the copending application, Ser. No. 784,365, the modulation electrodes 44*a* and 44*b* may be mounted on the walls 46 (only one of which is shown) of a U-shaped support which opens toward the beam guide plates 30 and 32**.

In the operation of the display device 10 a high positive potential, typically about +300 volts, is applied to each of the conductors 40, and a low positive potential, typically about +40 volts, is applied to the beam guide plates 30 and 32. A very high positive potential, typically about 8–10 Kv is applied to the phosphor screen 28. These potentials are with regard to the potential applied to the cathode 42. As described in the copending application, Ser. No. 671,358, now U.S. Pat. No. 4,088,920, issued May 9, 1978, the potential differences between the beam guide plate 30 and the conductors 40 and between the beam guide plate 32 and the phosphor screen 28 create electrostatic fields which extend into the space between the beam guide plates 30 and 32 which confine electrons to beams flowing between the beam guide plates along each of the longitudinal rows of the openings. The beams of electrons can be selectively deflected toward the phosphor screen 28 at selected points along the channels 26 by switching the potential applied to each of the conductors 40 to a negative potential, such as −100 volts. This will cause the beams to be deflected away from the negative conductor so that the beams will pass through the adjacent openings 34 in the beam guide plate 32. The beams will then impinge on the phosphor screen 28 to provide a line scan of the phosphor screen.

The electron beams are generated in the gun section 16 by heating the cathode to its emission temperature, typically about 760° C., to cause the cathode to emit electrons. With the potential applied to the modulation electrodes **44*a* and 44*b* sufficiently negative with respect to the potential applied to the cathode 42, typically about 70 volts more negative, the electrons emitted from the cathode will be trapped within the gun structure. When the potential applied to any pair of the modulation electrodes 44*a* and 44*b* is switched to a more positive potential, typically about no more positive than about −10 volts, the electrons in the region of such modulation electrodes will flow toward the positively charged beam guide plates 30 and 32 in the form of a beam. The tabs 36 and 38 which are adjacent these less negative modulation electrodes are at the same positive potential as the beam guide plates. The fields generated around these tabs penetrates toward the gun structure to create an acceleration field which draws the electrons between the guide plates along the longitudinal row of the guide plate openings. Thus, each pair of the tabs 36 and 38 serve to accurately guide a beam of electrons emitted from the gun structure between the beam guide plates 30 and 32** along a longitudinal row of the openings in the beam guide plates.

By making the modulation electrodes **44*a* and 44*b* of a dimension longitudinally along the cathode 42 greater than the corresponding, i.e. transverse, dimension of the beam, the edges of the modulation electrodes play a negligible role in where the beam is formed so that the modulation electrodes 44*a* and 44*b* need not be aligned with great precision with respect to the longitudinal rows of the openings in the beam guide plates. In the display device of the present invention the tabs 36 and 38 are the critical part since they determine where the electrons leave the cathode and enter into the beam guides. Thus, the tabs must be aligned with the openings in the beam guides with great precision. However, since the tabs 36 and 38 are an integral part of the beam guide plates 30 and 32**, they can be easily formed at the same time and by the same process as the openings are formed so that great precision of the position of the tabs with respect to the openings can be easily achieved. Thus, the display device of the present invention achieves accuracy of the injection of the electron beams into the beam guides from the gun structure with a structure which is relatively simple and easy to make and assemble.

Figure 3:
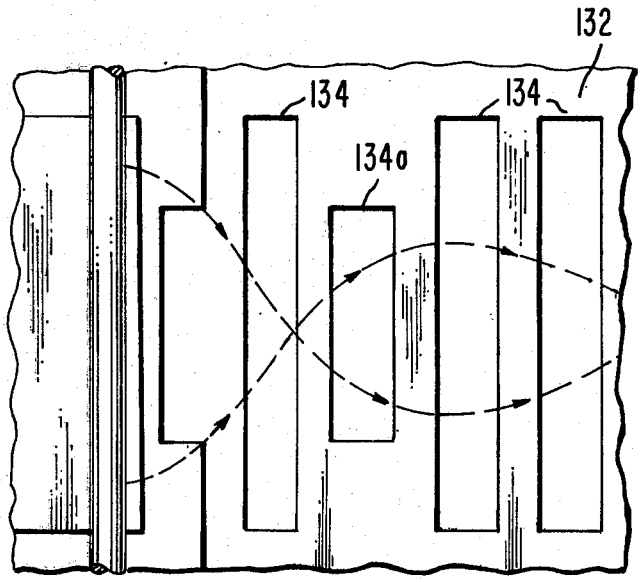
FIG. 3 is a top plan view of a modification of the beam guide and gun structure.

It is possible that the electrons may be injected into the beam guides with more lateral velocities than are desirable. This can be corrected by shaping the openings at the beginning of the beam guides to act as collimating lenses to help straighten out the beam. One method for achieving this is shown in FIG. 3 where the second opening 134a in the beam guide plate 132 has a dimension transversely of the channel smaller than the corresponding dimension of the other openings 134. The second opening in the other beam guide plate is of the same size. The display device shown in FIG. 3 is otherwise of the same structure as that shown in FIG. 2. The narrower openings 134A create electrostatic forces which laterally confine the electrons in the beam to a narrower beam so as to result in a straighten out of the beam.

Figure 4:
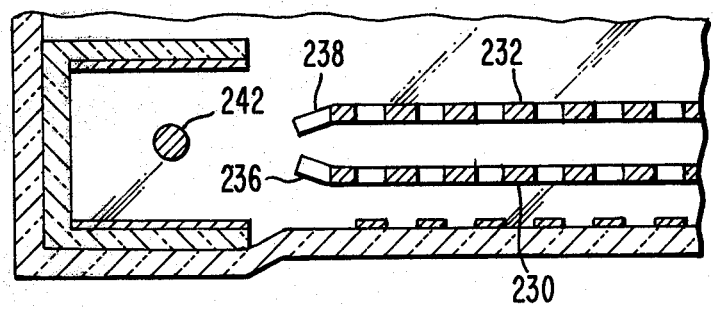
FIG. 4 is a sectional view through a portion of a further modification of the beam guide and gun structure.

Referring to FIG. 4 there is shown another modification of the display device in which the tabs 236 and 238 on the ends of the beam guide plates 230 and 232 extend slightly toward each other. In all other respects the display device shown in FIG. 4 is of the same structure as that shown in FIGS. 1 and 2. By having the tabs 236 and 238 extend slightly toward each other they extend closer to the cathode 242. This increases the electrostatic fields to achiever higher current densities from the cathode. This also results in the opening therebetween through which the electron beam from the gun structure passes, being made smaller so as to prevent entry into the beam guide of the electrons which would be close to the surfaces of the beam guide plates 230 232. This, along with a clean-up section of the type described in the copening application for U.S. Pat., Ser. No. 765,109, of C. H. Anderson, filed Feb. 2,1977, entitled "Flat Panel Display With Beam Injection Cleanup" will remove electrons which may hit the beam guide plates and be lost as the beam travels along the beam guide. This improves the chances that all of the electrons which enter the beam guide will flow along the entire length of the beam guide until the beam is deflected toward the phosphor screen so that the intensity of the beam that hits the phosphor screen will be uniform along the entire length of the beam guide.

I claim:

1. A display device comprising an evacuated envelope having spaced, substantially parallel front and back walls, an electron beam guide extending along said back wall for confining electrons in a beam as the beam flows along a path substantially parallel to said front wall and for selectively deflecting the beam toward a phosphor screen along said front wall at selected points along the beam path, gun means at one end of the beam guide for generating electrons and directing the electrons as a beam toward the beam guide, and projecting means on said beam guide at said one end of the beam guide for creating an electrostatic field which causes the electron beam to leave the gun means and enter the beam guide along said path.

2. A display device in accordance with claim 1 in which the beam guide includes a pair of spaced, parallel plates and the means on the beam guide is a tab projecting from the end of at least one of the plates.

3. A display device in accordance with claim 2 in which a tab projects from the said one end of each of the plates with the tabs being in overlapping relation with each other.

4. A display device in accordance with claim 3 in which the beam guide plates each have a plurality of openings therethrough arranged in an aligned row longitudinally along the beam path with each of the openings in one of the plates being aligned with a separate one of the openings in the other plate, and the tabs are in longitudinal alignment with the rows of the openings.

5. A display device in accordance with claim 4 in which the tabs extend toward each other so that the spacing between the free ends of the tabs is smaller than the spacing between the plates.

6. A display device in accordance with claim 4 in which the gun means includes a line cathode extending along said one end of the beam guide plates transversely across the beam path and a pair of modulation electrodes extending substantially parallel to said beam guide plates with the line cathode being between the modulation electrodes.

7. A display device in accordance with claim 6 in which the modulation electrodes are in longitudinal alignment with the rows of openings in the beam guide plates.

8. A display device in accordance with claim 7 in which the dimension of the modulation electrodes in the direction transversely of the beam path is at least as large as the corresponding dimension of the openings in the guide plates.

9. A display device in accordance with claim 8 in which the line cathode is positioned in a plane which is parallel to and between the planes of the beam guide plates.

10. A display device in accordance with claim 9 in which the openings in the beam guide plates are arranged in a plurality of spaced parallel rows to form a plurality of beam guides, a plurality of tabs project from the one end of each of the plates with each tab being aligned with a separate row of the openings, the gun means includes a line cathode which extends across each row of the openings and a separate pair of modulation electrodes aligned with each row of the openings.

* * * * *